United States Patent [19]

Numabe

[11] 4,043,109

[45] Aug. 23, 1977

[54] ELECTRONIC TIMEPIECE

[75] Inventor: Hitomi Numabe, Suwa, Japan

[73] Assignee: Kabushiki Kaisha Suwa Seikosha, Tokyo, Japan

[21] Appl. No.: 432,719

[22] Filed: Jan. 11, 1974

[30] Foreign Application Priority Data

Jan. 11, 1973 Japan ..... 48-5532

[51] Int. Cl.[2] ..... G04C 3/00

[52] U.S. Cl. ..... 58/23 R; 58/23 AC; 58/85.5; 58/50 R; 310/346

[58] Field of Search ..... 58/23 R, 23 A, 23 AC, 58/23 TF, 23 V, 85.5, 50 R; 310/116 R, 116 M, 176, 8.9

[56] References Cited

U.S. PATENT DOCUMENTS

| | | | |
|---|---|---|---|
| 2,471,143 | 5/1949 | Cress | 310/8.9 X |
| 3,289,055 | 11/1966 | Aizawa et al. | 331/116 R |
| 3,322,981 | 5/1967 | Brenig | 310/8.9 |
| 3,540,207 | 11/1970 | Keeler | 58/23 R |
| 3,541,779 | 11/1970 | Langley | 58/23 R X |
| 3,568,093 | 3/1971 | Ishida et al. | 331/116 R |
| 3,719,838 | 3/1973 | Peduto et al. | 331/176 X |
| 3,777,471 | 12/1973 | Koehler et al. | 58/85.5 X |
| 3,792,377 | 2/1974 | Fujita et al. | 58/23 A |
| 3,810,355 | 5/1974 | Ito | 58/23 A |
| 3,895,486 | 7/1975 | Hammer et al. | 58/85.5 X |

FOREIGN PATENT DOCUMENTS

| | | | |
|---|---|---|---|
| 534,913 | 8/1972 | Switzerland | 58/23 R |

*Primary Examiner*—Ulysses Weldon

*Attorney, Agent, or Firm*—Blum, Moscovitz, Friedman & Kaplan

[57] ABSTRACT

An electronic wristwatch having a quartz crystal vibrator serving as a time standard, a display, and an electronic divider circuit for dividing the high frequency signal supplied by the quartz crystal vibrator into a low frequency timekeepng signal and applying same to the display. A quartz crystal oscillator circuit is adapted to be compensated during changes in temperature to stabilize the operation thereof, and a divider regulating circuit is provided selectively to regulate the period of the timekeeping signal produced by the divider circuit. The regulating circuit is completely independent of the quartz crystal oscillator circuit, and regulation of the period of the timing signal has no effect on the operation of the oscillator circuit.

9 Claims, 8 Drawing Figures

ELECTRONIC TIMEPIECE

BACKGROUND OF THE INVENTION

This invention relates generally to small-sized quartz crystal electronic timepieces, and in particular to providing regulating circuitry to such timepieces which is independent of the quartz crystal vibrator circuit. Quartz crystal vibrators are known to be extremely sensitive to changes in temperature. Thus, temperature compensation circuitry is often provided in the quartz crystal oscillator circuit of an electronic timepiece to compensate for changes in the surrounding temperature. In addition to temperature, the frequency at which the oscillator circuit oscillates is sensitive to changes in the capacitance, resistance, etc. included in the circuit. Heretofore, it has been the practice to include a fixed capacitor for providing temperature-sensitive compensation and a variable capacitor for selectively regulating the frequency of the timing signal produced by the quartz crystal oscillator circuit. However, although the fixed capacitor provided the necessary temperature compensation at a fixed frequency, the variable capacitor utilized for regulating the frequency of the circuit caused a change in the equivalent capacitance of the circuit. For this reason, the temperature response characteristic of the temperature compensating capacitor is not uniform at all frequencies to which the oscillator can be set by the regulating variable capacitor, so that independent temperature compensation and frequency regulation becomes impossible.

SUMMARY OF THE INVENTION

Generally speaking, in accordance with the invention, an electronic timepiece is provided having a quartz crystal oscillator circuit for producing a high frequency time standard signal, a divider circuit for producing low frequency timekeeping signals from the high frequency time standard signal and including a plurality of series connected divider stages, and a display for displaying time in response to the low frequency timekeeping signals. Circuit means for compensating for changes in the temperature is included in said oscillator circuit to stabilize the high frequency output thereof with respect to temperature changes. Regulating circuitry is coupled to the divider circuit to regulate the period of the low frequency timekeeping signals, to thereby render the oscillator circuit operable and independent of changes in temperature and such regulation.

Accordingly, it is an object of this invention to provide an improved quartz crystal wristwatch wherein the oscillator circuit is not affected by regulation of the timekeeping frequency of the wristwatch.

Another object of this invention is to provide an improved quartz crystal wristwatch wherein temperature compensation in the oscillator circuit is not affected by regulation of the timekeeping frequency.

A further object of this invention is to provide an improved crystal vibrator wristwatch capable of improved regulation.

Still other objects and advantages of the invention will in part be obvious and will in part be apparent from the specification.

The invention accordingly comprises the features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
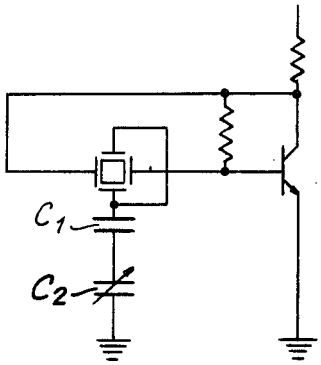
FIG. 1 PRIOR ART
FIG. 1 is a circuit diagram of a conventional oscillator circuit utilized in quartz crystal wristwatches.

Reference is now made to FIG. 1 wherein a quartz crystal oscillator circuit utilized in prior art electronic wristwatches is depicted. The oscillator circuit includes a fixed capacitor $C_1$ which is adapted to sense changes in temperature and compensates for same to stabilize the frequency at which the circuit oscillates. A second variable capacitor $C_2$ is coupled in series with capacitor $C_1$ and is adapted to permit selective regulation of the frequency at which the oscillator circuit is to operate. The capacitors are coupled in the manner depicted so that the temperature compensation is affected simultaneously as the circuit is regulated. However, the temperature compensation which capacitor $C_1$ provides is not adequate when the regulating capacitor $C_2$ is varied to regulate the frequency output of the circuit.

Ideally, the temperature compensation characteristic of capacitor $C_1$ would be uniform at all settings of capacitor $C_2$, but this is not the case. Due to the interaction of temperature compensation and regulation, it is not possible to accurately perform independent regulation and temperature compensation by the circuit of FIG. 1.

Figure 2:
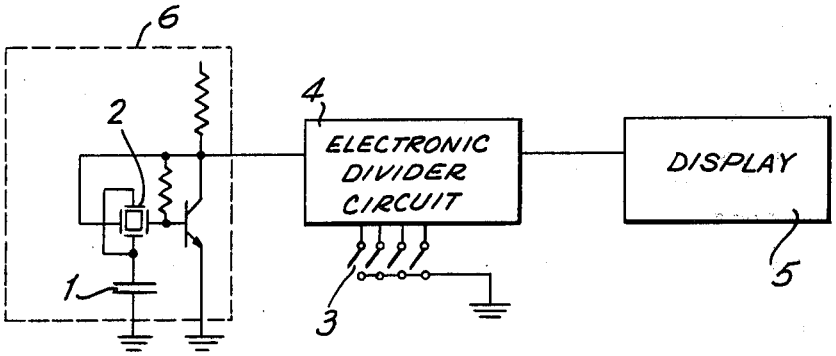
FIG. 2 is a circuit diagram of an electronic timepiece including an oscillator circuit and a regulating circuit constructed in accordance with the instant invention.

Reference is now made to FIG. 2 wherein an electronic timepiece constructed in accordance with the instant invention is depicted. A quartz crystal oscillator circuit 6 provides high frequency signals to an electronic divider circuit 4 which receives the high frequency signal and provides a low frequency timekeeping signal to the display circuit 5. The quartz crystal oscillator circuit 6 includes a quartz crystal vibrator 2 and a temperature sensitive capacitor 1 for compensating for changes in temperature. Thus, the oscillator circuit produces frequencies which are not affected by changes in temperature.

Figure 7:
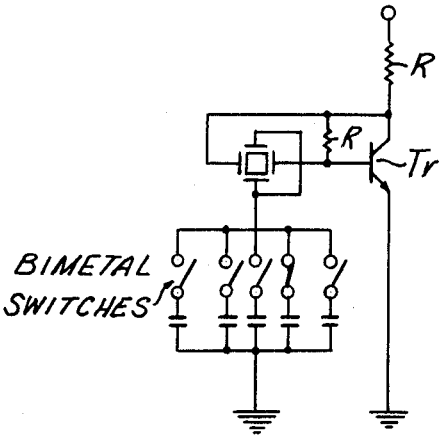
FIG. 7 is a circuit diagram of an oscillator circuit including fixed capacitors and bi-metal switches in accordance with still another embodiment of the instant invention.

Capacitor 1 can be formed with a barium titanate electrolyte to effect temperature compensation. In the alternative, a temperature sensitive switch may be provided for selectively connecting one of a plurality of fixed capacitors in the circuit dependent on temperature. An example of such a switch is a bimetal activated switch, such as the circuit depicted in FIG. 7. Still another temperature compensating device which may be used in place of capacitor 1 is a temperature sensitive resistant device such as a thermistor. In fact, any temperature compensating device may be used in the circuit in accordance with the invention.

Figure 3:
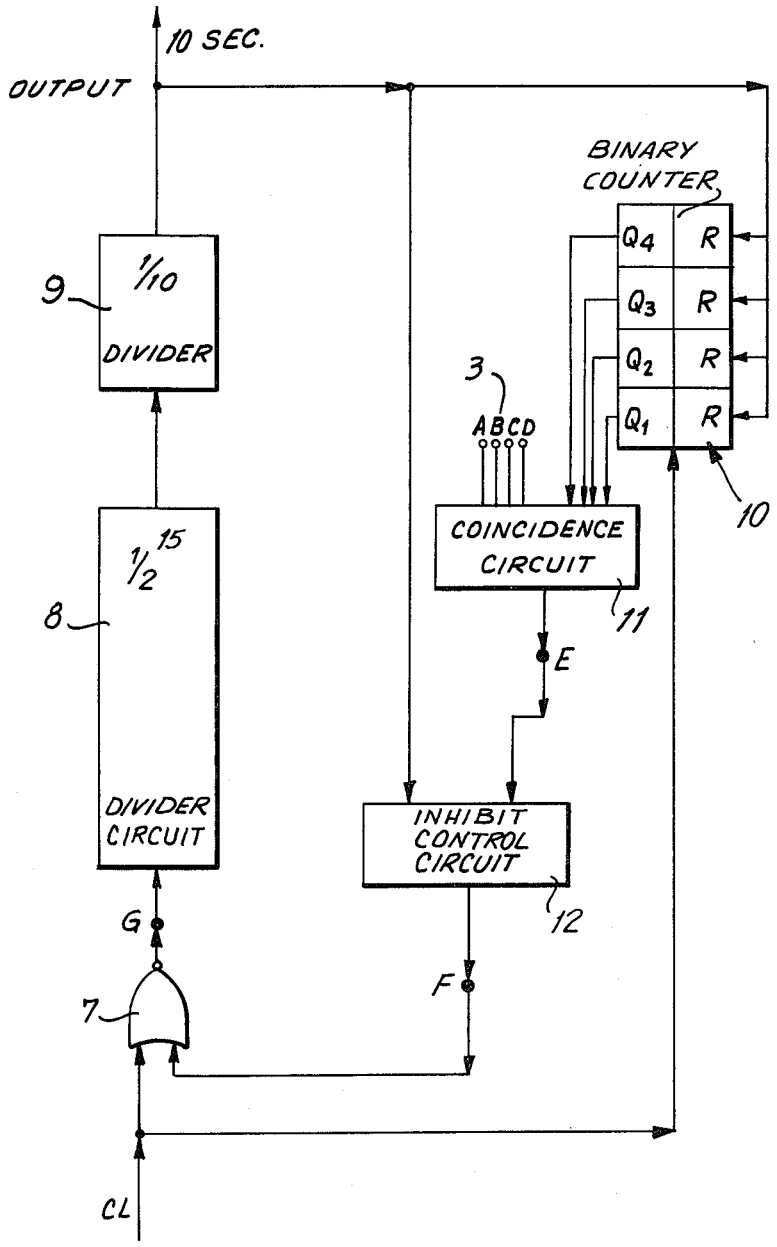
FIG. 3 is a circuit diagram of a frequency regulating circuit as depicted in FIG. 2.
Figure 4:
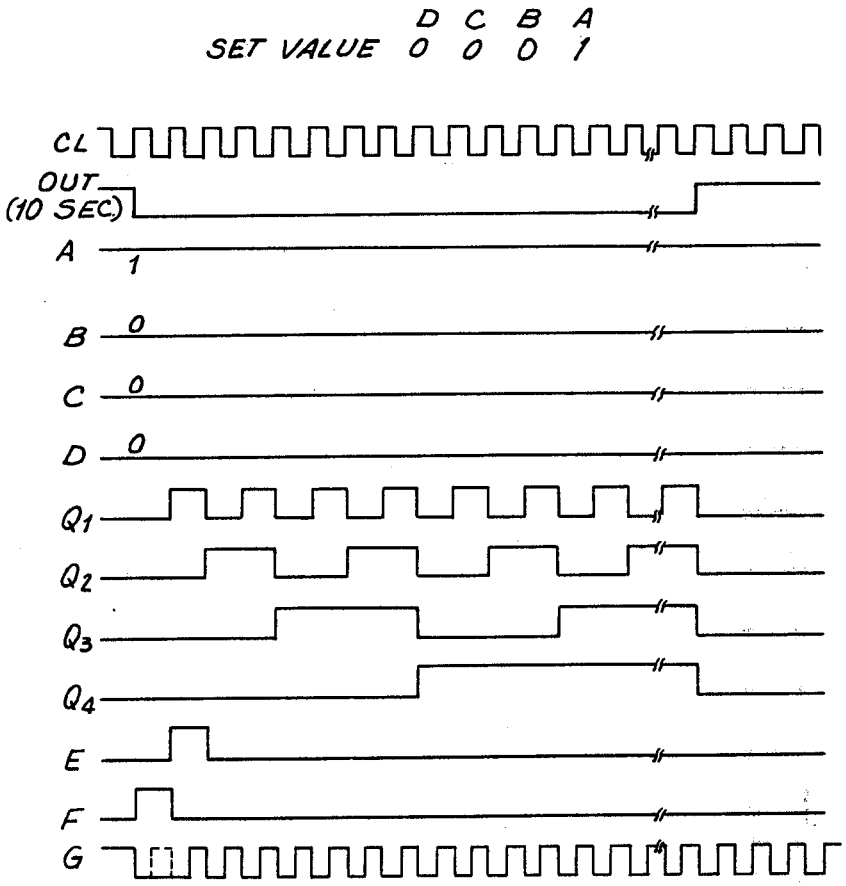
FIGS. 4 and 5 are wave diagrams of the regulating circuit of FIG. 3 in operation.
Figure 5:
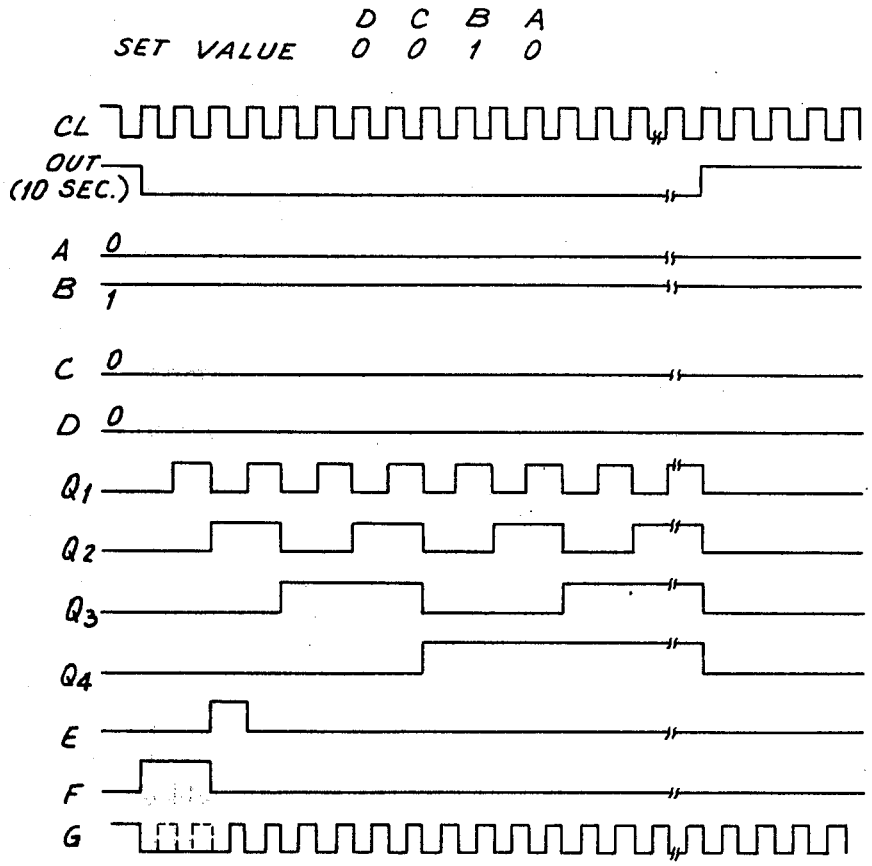

The electronic divider circuit 4 includes a regulating circuit such as is depicted in FIG. 3 and is regulated by setting switches 3 adapted to regulate the period of the low frequency timekeeping signal of the output of divider circuit 4. Specifically, a high frequency clock pulse CL of 32,768 Hz is applied to a first input of an inhibit gate such as NOR gate 7. The output G of said inhibit gate is applied to a divider circuit 8 which includes a divider circuit comprised of a plurality of series-connected flip-flops which are adapted to divide the high frequency timekeeping signals by $2^{15}$ and apply the resultant 1 second signal to a 1/10 divider 9 to provide a 10 second output signal. The 10 second output signal is supplied as a first input to inhibit control circuit 12 which provides an output signal F to the other input of NOR gate 7, signal F being utilized to gate the clock pulse CL into the divider circuit 8 in a manner to be hereinafter discussed. A four bit binary counting circuit 10 also has applied thereto input clock pulse CL as the counting signal and each bit of the four bits counted thereby is reset by applying the 10 second output pulse to the respective bit reset terminals R of counting circuit 10. The outputs $Q_1$ through $Q_4$ of the binary counter circuit are applied to a coincidence circuit which has four setting switches 3 applying an input thereto. When the signals provided by the four setting switches A, B, C and D and the output of the binary counting circuit are coincident, the signal E depicted in FIGS. 4 and 5 is generated. It is appreciated that for the embodiment depicted in FIG. 3 wherein four setting switches are shown, 16 kinds of settings can be performed and the range of regulation can be from 0 to 4.5 seconds a day. Moreover, it is appreciated that this regulation takes place independently of the oscillator circuit and therefore does not affect the operation thereof.

Reference is now made to FIG. 4, wherein the operation of the circuit depicted in FIG. 3 when A equals 1 and B, C and D equals 0 is depicted. The binary counting circuit 10 in response to the high frequency time standard signal CL and the negative half cycle of the 10 second output signal from divider 9, applies binary divided signals $Q_1$ through $Q_4$ to the coincidence circuit 11. The coincident circuit has four setting switches A, B, C and D to thereby provide 16 settings, 16 representing the number of different combinations of 1 to 0 provided by four two-position switches. Since only setting switch A is set to 1 the only pulse supplied by the coincident circuit as a first input E to the inhibit control circuit 12 is the first pulse $Q_1$ provided by the first binary counter stage. The 10 second output signal from the one-tenth divider 9 is applied as the second input to the inhibit control circuit 12. The inhibit control circuit in response to the coincident application of the negative half-cycle of the 10 second signal (when the 10 second signal is at a 0 binary state) and pulse E (when pulse E is at a 1 binary state) produces inhibit pulse F. Inhibit pulse F is thereafter applied to inhibit gate 7, the pulse width of the inhibit pulse F determining the number of clock pulses applied to the divider circuit 8 to be inhibited.

Referring to FIG. 5, if A, C and D are set to 0, and B is set to 1 the pulse produced by $Q_2$ is selected as coincident circuit output pulse E, and in response to the application of same to the inhibit control circuit 12 during the negative half cycle of 10 second signal from output divider 9, gating pulse F is applied to NOR gate 7 to effect inhibiting of two clock pulses applied to the divider chain. Thus, as in FIG. 4, the occurrence of the leading edge of the pulse E during the negative half cycle of the 10 second signal determines the width of the inhibit pulse F which is capable of inhibiting from 1 to 16 pulses during each 10 second pulse produced by the one tenth divider 9, to thereby provide a range of regulation from 0 to 4.5 seconds per day.

Figure 6:
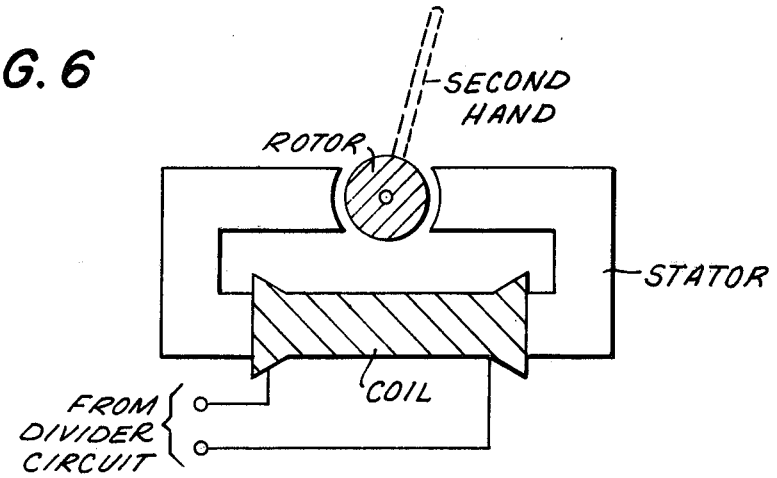
FIG. 6 is an elevational view of a stepping motor adapted to be utilized in the timekeeping circuit depicted in FIG. 3.
Figure 8:
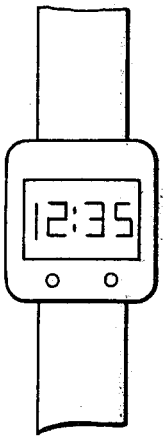
FIG. 8 is a perspective view of an electronic wristwatch including a digital display.

It is noted that the display can be a mechanical movement including a stepping motor, as depicted in FIG. 6, for receiving the low frequency timekeeping signals from the divider circuit to thereby drive the movement. In the alternative, the display can be of the digital type as depicted in FIG. 8, and include a decoding and driving circuit for receiving low frequency timing signals from the divider circuits and provide signals to energize the digital display elements in a well known manner.

What is claimed is:

1. In an electronic wristwatch having a quartz crystal oscillator circuit adapted to oscillate at a predetermined frequency and produce a high frequency time standard signal, divider circuit means including a multi-stage divider chain for producing low frequency timekeeping signals in response to said high frequency time standard signal and means for the display of time in response to said timekeeping signals, the improvement which comprises said oscillator circuit including means for compensating for changes in temperature to render said high frequency time standard signal produced thereby substantially unaffected by temperature changes; and frequency regulating means coupled to said divider circuit means intermediate said oscillator circuit and divider circuit means for selectively regulating the frequency of said timekeeping signals by effecting continuous adjustment of said high frequency signal without changing the frequency at which said oscillator circuit oscillates, said divider frequency regulating means including inhibit means for inhibiting at least one period of said high frequency signal, said inhibit means including switch means for selecting a coincident count, said inhibit means further including a multi-bit binary counter having one bit for each setting switch means, means for applying said high frequency signal to be inhibited to said binary counter for counting thereby, means for applying a low frequency signal from said divider chain to said binary counter for resetting same, coincident circuit means for receiving the output of said binary counter and the coincidence count from said setting switch means and in response to the coincident states thereof, producing an output pulse; and inhibit circuit means for receiving the output pulse of said coincident circuit means and the low frequency signal and in response thereto inhibiting the transmission to the next divider stage of a number of periods of the high frequency signal corresponding to said coincidence count.

2. In an electronic timepiece as claimed in claim 1, wherein said oscillator circuit temperature compensation means includes temperature sensitive elements.

3. An electronic timepiece as claimed in claim 2, wherein said temperature sensitive element is a capacitor.

4. An electronic timepiece as claimed in claim 3, wherein said capacitive temperature sensitive element includes a barium titanite dielectric.

5. An electronic timepiece as claimed in claim 3, wherein said temperature compensating means includes a plurality of fixed capacitors and temperature sensitive switch means for selectively connecting one or more of said capacitors in response to the temperature.

6. An electronic timepiece as claimed in claim 5, wherein said temperature sensitive switch means includes a bimetal controlled switch.

7. An electronic timepiece as claimed in claim 1, wherein said display means includes a digital display.

8. An electronic timepiece as recited in claim 1, wherein said display means includes a stepping motor and movement means driven by said stepping motor.

9. A regulating circuit for an electronic timepiece including an oscillator circuit for producing a high frequency signal, a multi-stage divider circuit for receiving a high frequency signal and producing low frequency timekeeping signals and comprising means for regulating the frequency of said divider circuit means, said divider frequency regulating means including inhibit means for inhibiting at least one period of a high frequency signal of a stage of said divider chain to thereby regulate the period of the low frequency timekeeping signals produced by said divider circuit means, said inhibit means including control circuit means having setting switch means coupled thereto, said switch means being adapted to select the number of periods of said high frequency timekeeping signal to be inhibited, and said inhibit means further including a multi-bit binary counter having one bit for each setting switch means, means for applying a low frequency signal from said divider chain to said binary counter for resetting same, coincidence circuit means for receiving the output of said binary counter and setting switch means and producing an output pulse in response to detecting coincidence; inhibit circuit means for receiving as a first input the output pulse of said coincidence circuit means and as a second input said low frequency signal applied to said binary counter, and in response thereto producing a coincident count signal, inhibit gate means for receiving said high frequency signal and the coincidence count signal of said inhibit circuit means and inhibiting the transmission to the next divider stage of periods of the high frequecy signal determined by the occurrence of said coincidence count signal.

* * * * *